United States Patent [19]

Barret

[11] 4,375,792

[45] Mar. 8, 1983

[54] ASYMMETRICAL INTERNAL COMBUSTION ENGINE

[76] Inventor: Paul Barret, 5 bis, Avenue Beziou, 64140 Billere, France

[21] Appl. No.: 155,456

[22] Filed: Jun. 2, 1980

[30] Foreign Application Priority Data

Jun. 19, 1979 [FR] France ..... 79 16185

[51] Int. Cl.[3] ..... F02B 75/28

[52] U.S. Cl. ..... 123/51 AA; 123/51 BA; 123/197 AC

[58] Field of Search ..... 123/197 R, 197 AB, 197 AC, 123/51 R, 51 AA, 51 BA, 51 A, 48 B, 78 F, 64

[56] References Cited

U.S. PATENT DOCUMENTS

| | | | |
|---|---|---|---|
| 1,191,827 | 7/1916 | Reese | 123/197 AC |
| 2,311,311 | 2/1943 | Lacy | 123/51 |
| 2,840,060 | 6/1958 | Johansson | 123/197 AC |
| 2,896,596 | 7/1959 | Abraham | 123/51 |
| 3,301,244 | 1/1967 | Renshaw | 123/197 R |

FOREIGN PATENT DOCUMENTS

| | | |
|---|---|---|
| 674598 | 12/1965 | Belgium . |
| 2260374 | 6/1974 | Fed. Rep. of Germany . |
| 923811 | 7/1947 | France . |
| 561067 | of 1944 | United Kingdom . |
| 662056 | 11/1951 | United Kingdom . |

*Primary Examiner*—Charles J. Myhre
*Assistant Examiner*—Andrew M. Dolinar
*Attorney, Agent, or Firm*—Erwin S. Teltscher

[57] ABSTRACT

An internal combustion engine adapted to be powered by a burnable gaseous fuel includes one cylinder, first and second pistons reciprocally movable in the cylinder substantially in opposite directions, inlet and outlet valves for controlling the flow of the gaseous fuel into the cylinder, and the exhaust of the burnt fuel therefrom, respectively, and a linkage device connected to the pistons for converting the reciprocating movement thereof into a rotary movement. The linkage device includes change-of-rate-of-displacement devices for increasing the rate of velocity in the maximum acceleration range, and for reducing the rate of displacement in the maximum velocity range of one piston with respect to the other piston, first and second piston rods pivotably connected to the first and second pistons, respectively, first and second crankshafts pivotably connected to the first and second piston rods, rotatable about first and second axes disposed substantially parallel to, and displaced by a predetermined angle from one another, respectively, and a gear train coupling the first and second crankshafts to one another. The gear train includes first and second fixedly mounted gearwheels, first and second concentrically mounted gear wheels, and a position-shiftable coupling mechanism for coupling the first gear wheels and the second gear wheels to one another, respectively, and an engaging device for meshing the eccentrically mounted gear wheels with one another.

10 Claims, 12 Drawing Figures

ASYMMETRICAL INTERNAL COMBUSTION ENGINE

BACKGROUND OF THE INVENTION

Known types of internal combustion piston engines consume large quantities of energy for a low power output. This is mainly due to the fact that the connecting rod-crankshaft system is at outer dead center when combustion of the gases takes place. As the crankshaft is mounted at an angle of 180° when it receives the maximum thrust from its piston, it can only utilize part of the thrust, because of the inertia of its flywheel. This construction accounts for the low power obtained in proportion to the energy consumed.

French Pat. No. 923,811 issued to Ramaut teaches a partial solution to this basic problem. Remaut teaches in an internal combustion engine the use of a cylinder, first and second pistons reciprocally movable in the cylinder in opposite directions, inlet and outlet valves for controlling the flow of gaseous fuel into the cylinder, and the exhaust of the burnt fuel therefrom, respectively, and linkage means connected to the pistons for converting the reciprocable movement thereof into a rotary movement, the linkage means including change-of-rate-of-displacement means for speeding up the maximum acceleration range, and slowing down the maximum velocity range of one piston with respect to the other piston, as does applicant. But Ramaut's linkage means, as best seen from Ramaut's FIG. 1, include change-of-rate-of-displacement means which are very complicated, and include cam means, and cam-follower means, which need precise alignment; the operation of Ramaut's engine may be severely disturbed, if the alignment of the cam and cam follower is not kept up to the precision required by Ramaut. The use of eccentric gear mechanisms has been suggested by Grodzinski in British Pat. No. 561,067, but in a way different from the mechanism employed in the present invention; Grodzinski multiplies the number of eccentric gears in the mechanism, and by using only small individual eccentricities, no great variations in the actual center distances of the gears is caused, and therefore no excessive backlash is present. Vickers, in Belgian Pat. No. 674,598 also teaches of pistons moving in opposite directions in a cylinder, but does not use change-of-rate-of-displacement means according to the present invention. Timsons, British Pat. No. 662,056 teaches gearing for conveying rotary motion including a pair of non-meshing gears spaced apart in a common plane, a pair of intermeshing gears each of which is arranged in mesh with one of the pair of spaced non-meshing gears so that the latter will rotate in opposite directions, links of the same length directly connecting central pivots on the spaced non-meshing gears with central pivots on the intermeshing gears, and a further link connecting the last-mentioned pivots, the three links together providing an open-sided link frame, and this frame and the axes of the spaced non-meshing gears being relatively movable so as to effect relative circumferential motion of the latter. Timsons, although teaching improvements in gearing arrangements designed to enable relative circumferential motion of desired gears in a group to be varied without interruption, does not implement the change-of-rate of displacement means in a manner disclosed in the present invention. Stieve, German laid-open specification No. 2,260,374, teaches a gear train applicable to internal combustion engines using an eccentrically mounted drive gear to drive another eccentrically mounted gear connected to a piston rod, which in turn is reciprocally movable in a piston. Stieve's mechanism is also different from that of the present invention, and not applicable thereto. Other double piston internal combustion engines are taught by Abraham, U.S. Pat. No. 2,896,596, and Lacy, U.S. Pat. No. 2,311,311, but do not come close to the present invention.

SUMMARY OF THE INVENTION

An internal combustion engine adapted to be powered by a burnable gaseous fuel includes one cylinder, first and second pistons reciprocally movable in the cylinder substantially in opposite directions, inlet and outlet valves for controlling the flow of the gaseous fuel into the cylinder, and the exhaust of the burnt fuel therefrom, respectively, and a linkage device connected to the pistons for converting the reciprocating movement thereof into a rotary movement. The linkage device includes change-of-rate-of-displacement devices for increasing the rate of velocity in the maximum acceleration range, and for reducing the rate of displacement in the maximum velocity range of one piston with respect to the other piston, first and second piston rods pivotably connected to the first and second pistons, respectively, first and second crankshafts pivotably connected to the first and second piston rods, rotatable about first and second axes disposed substantially parallel to, and displaced by a predetermined angle from one another, respectively, and a gear train coupling the first and second crankshafts to one another. The gear train includes first and second fixedly mounted gearwheels, first and second concentrically mounted gear wheels, and a position-shiftable coupling mechanism for coupling the first gear wheels and the second gear wheels to one another, respectively, and an engaging device for meshing the eccentrically mounted gear wheels with one another.

The coupling means preferably include first and second toothed wheels rigidly mounted with the first and second eccentrically mounted wheels about respective common first and second rotating axes, which engage the first and second gear wheels, respectively; additionally position-shiftable support means are provided, and at least one of the eccentrically mounted gear wheels is rotatably mounted on the position-shiftable support means.

The engaging means include a plate formed with first and second recesses, the first and second roller bearings mounted on, and extending from the first and second eccentrically mounted gear wheels, so as to be able to roll freely in respective recesses. The position-shiftable support means advantageously include a member which has one end pivotably mounted on at least one of the gear wheels, and wherein the one of the eccentrically mounted wheels is rotatably mounted on the other end of the member.

The first and second toothed wheels also include first and second shafts concentric therewith, and concentric with the first and second axes, respectively.

One of the eccentrically mounted gear wheels preferably has a diameter exceeding the diameter of the toothed wheel engaged therewith, and each of the fixedly mounted gear wheels preferably has about twice the diameter of each of the toothed wheels.

In a preferred embodiment of the combustion engine the number of pistons is twice the number of cylinders.

Advantageously resilient means, such as a spring, are coupled to at least the position-shiftable support means for urging the eccentrically mounted gear wheels to make contact with one another. The predetermined angle has advantageously one of the values $\pm 90° + n.180°$, where n is an integer.

BRIEF DESCRIPTION OF THE DRAWINGS

The invention will be better understood with the aid of the drawing, in which.

DESCRIPTION OF THE PREFERRED EMBODIMENTS

Figure 1:
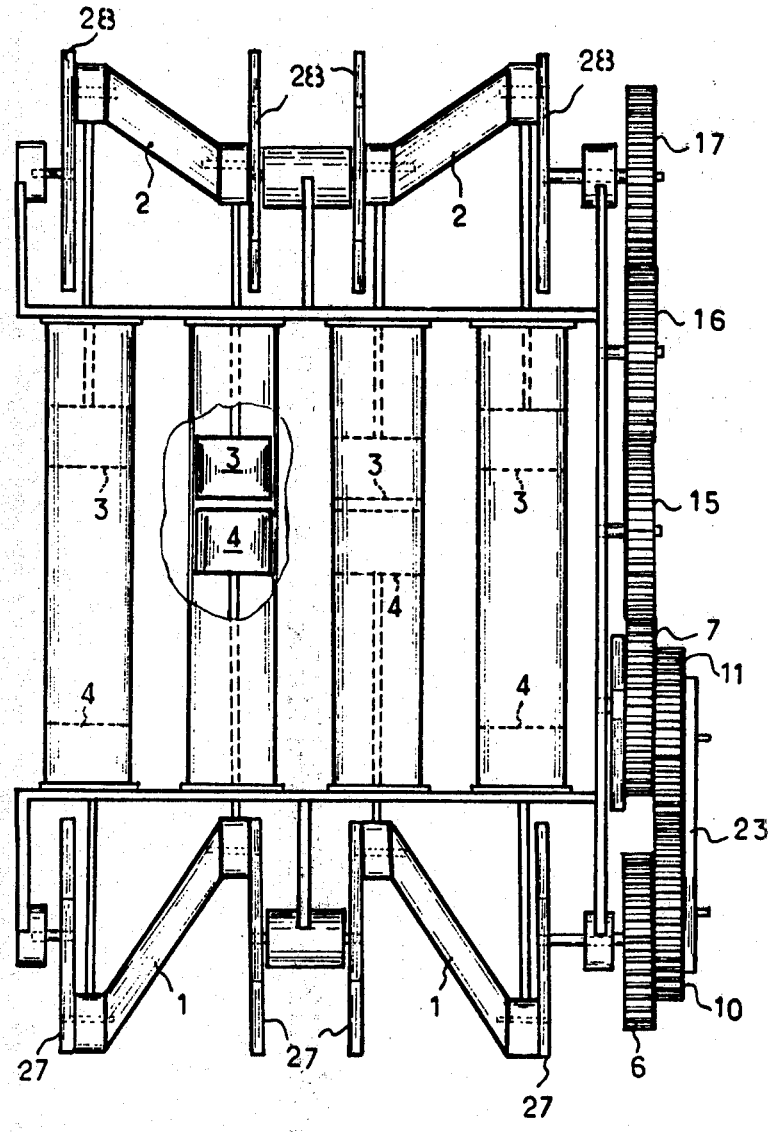
FIG. 1 is an elevational view of an internal combustion engine, according to my invention.

Referring now to the drawings, an internal combustion engine which is adapted to be powered by a burnable gaseous fuel will be seen to consist of a cylinder 100, and pistons 3 and 4 which move reciprocally in the cylinder 100 in opposite directions. Each piston 3 and 4, as is well known, has a maximum velocity range, and a maximum acceleration range. The internal combustion engine is fitted with inlet and outlet valves 24 and 25 for controlling the flow of the gaseous fuel into the cylinder 100, and the exhaust of the burnt fuel from the cylinder 100. As is well known, linkage means, such as crankshafts 1 and 2, are connected to the pistons 3 and 4 for converting the reciprocable movement of the pistons 3 and 4 into a rotary movement.

It is a key feature of the present invention that the linkage means include change-of-rate of displacement means, to be explained in detail later, for increasing the rate of velocity in the maximum acceleration range, and for reducing the rate of displacement in the maximum velocity range of one piston with respect to the other piston.

It is well known that the linkage means may also include, for example, piston rods 101 and 102 which are pivotably connected to the pistons 3 and 4, respectively. The crankshafts 1 and 2 may be rotated about first and second axes disposed substantially parallel from, and displaced by a predetermined angle, for example 90°, with respect to one another. The crankshafts are pivotably connected to the piston rods 101 and 102, and a gear train, to be described later, couples the crankshafts 1 and 2 to one another.

The gear train may consist, for example, of fixedly mounted gear wheels 6 and 7, eccentrically mounted gear wheels 10 and 11, and coupling means, which are at least partially position-shiftable for coupling the first gear wheels 6 and 10, and the second gear wheels 7 and 11 to one another, respectively. The coupling means may include toothed wheels 8 and 9 rigidly mounted with the eccentrically mounted wheels 10 and 11 about respective common rotatable shafts 18 and 19. The toothed wheels 8 and 9 will be seen, in turn, to engage the gear wheels 6 and 7, respectively. In the example shown, the coupling means further includes engaging means for meshing the eccentrically mounted gear wheels 10 and 11 with one another. The engaging means may, in turn, consist of a plate 23 formed with first and second recesses, and first and second roller bearings 22 mounted on, and extending from the eccentrically mounted gear wheels 10 and 11, respectively, so that the roller bearings 22 can freely roll in the respective recesses.

The coupling means may also include position-shiftable support means, for example, a plate member 20, which has one end mounted pivotably on a gear wheel 7, and wherein one eccentrically mounted wheel 11 is pivotally mounted on the other end of the plate member 20.

OPERATION

As will be seen from the drawing, on the one hand the piston 4 transmits its thrust to the gear wheel 6 by means of the crankshaft 1 and its associated drive wheels 27, and on the other hand the piston 3 transmits its thrust to the gear train composed of gear wheels 17,16,15 and 7 coupled in series by means of the crankshaft 2 and its associated drive wheels 28. The gear wheels 6 and 7, in turn, drive toothed wheels 8 and 9, best seen in FIG. 2, which toothed wheels 8 and 9 in turn engage eccentrically mounted gear wheels 10 and 11.

Figure 2:
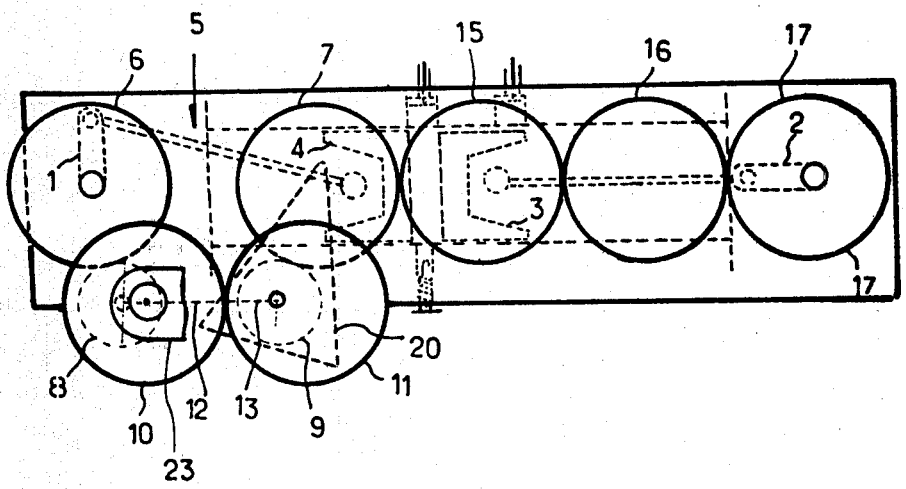
FIG. 2 is a diagrammatic arrangement of the gear train of my invention.
Figure 4:
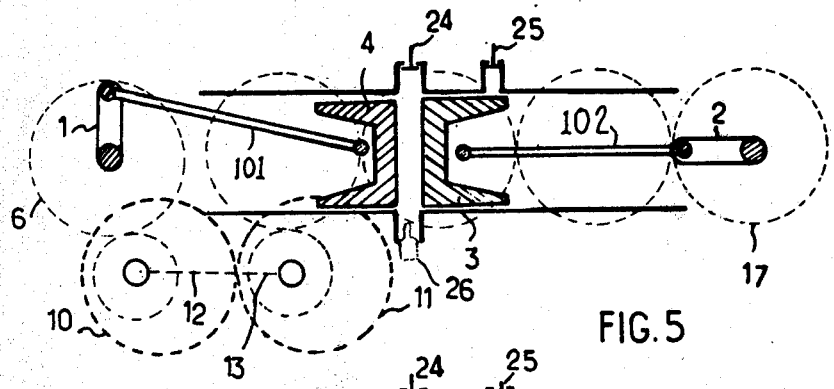
FIG. 4 is a fragmentary elevational view of the relative positions of the pistons in a first position of the operating cycle of the engine.

As seen in FIG. 2, when the crankshaft 1 subtends an angle of 90°, rotating in an anti-clockwise direction, the crankshaft 2 subtends an angle of 180°, namely is at the inner dead center, which corresponds to the point of combustion of the cylinder concerned. If the two crankshafts 1 and 2 were connected to one another only by a series of gear wheels of identical construction, it would be difficult, or even impossible for the engine to operate properly. This would be so, because the piston 3, approaching its inner dead center, (160° ), would only have a short way to travel, whereas the opposed piston 4, in the region from 120° to 60°, would have to travel over a much greater linear distance. The result would be a significant displacement of the ignition point, which would nullify the proper operation of the engine. To overcome this difficulty, it is proposed to accelerate the crankshafts 1 and 2, when they travel in the respective regions from 150° to 210°, and from 330° to 30°, and in turn to decelerate them, when they travel in the regions from 60° to 120° and from 240° to 300°. To implement this mode of operation, a gap 5 is formed within the gear train 6, 7, 15, 16, and 17, connecting the crankshafts 1 and 2. If the engine has several cylinders, which is of interest in the present case, the gear wheels 6 and 7 must engage the toothed wheels 8 and 9, respectively, which have half the diameter of the gear wheels 6 and 7. On the shafts or pins 18 and 19 of the toothed wheels 8 and 9 there are eccentrically mounted the gear wheels 10 and 11, whose dimensions are identical to those of gear wheels 6 and 7. The two eccentrically mounted gear wheels 10 and 11 mesh with one another, and it is through the gear wheels 10 and 11 that the forces developed by the crankshafts 1 and 2 are coupled. The eccentricity of the gear wheels 10 and 11 may be made variable. Depending on the respective length of the stroke, it is possible, by decreasing or increasing the eccentricity, respectively, to obtain an almost perfectly regular and linear stroke. In the respective initial position, namely 90° for crankshaft 1, and 180° for crankshaft 2, as shown in FIG. 4, i.e. when the ignition takes place in one cylinder, the eccentric gear wheels 10 and 11 should be in diametrically opposed eccentric positions, that is, the gear wheel 10 would, at that instant, operate on its longest radius 12, when it meshes with the gear wheel 11, which, in turn, should at that instant, operate on its shortest radius 13. The effect of this instantaneous alignment is to slow down the the crankshaft 1, and to accelerate the crankshaft 2. As the eccentrically mounted gear wheels 10 and 11 revolve twice as fast as the crankshafts 1 and 2, it follows that the two regions of acceleration and the two regions of deceleration may be mechanically provided for in any cylinder.

It is obvious that if the two eccentrically mounted gear wheels 10 and 11 were revolving at the same speed as the engine, a crankshaft positioned at 90° or 270°, i.e. in a deceleration region, would be in an acceleration region half a turn later. The relation between the acceleration and deceleration regions substantially applies also to other positions of the crankshafts, and such a relationship would prevent a multicylinder engine from operating properly. However, the arrangement outlined would be suitable for an engine with only one cylinder, and two pistons.

Figure 3:
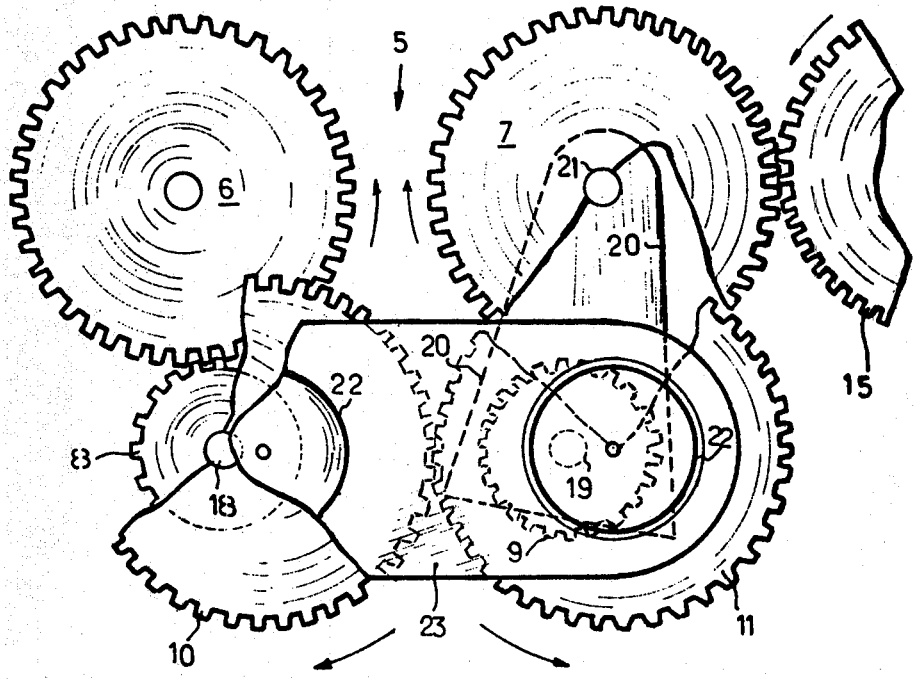
FIG. 3 is an enlarged detail of FIG. 2.

FIG. 3 shows the juxtaposition of the various transmission gears meshing and cooperating with the eccentrically mounted gear wheels 10 and 11. The two eccentric gear wheels 10 and 11 engaging one another without any additional measures would either jam or become disengaged from one another at some points of their respective rotations. To eliminate this phenomenon, it is proposed to cause the eccentric gear wheel 10 to revolve around a fixed pin or shaft 18 on which there is also mounted the toothed wheel 8. Similarly, the eccentric gear wheel 11 is mounted together with the toothed wheel 9 on a shaft or pin 19 mounted on a position-shiftable support 20, which is in turn pivotable around a shaft or pin 21 of the gear wheel 7. The gear wheel 7 drives the toothed wheel 9 directly, and the toothed wheel 9, in turn, is rigid with the gear wheel 11. To obviate the possibility of jamming and/or disengagement of the eccentric gear wheels 10 and 11 indicated above, it is preferable to cause the gear wheels 10 and 11 to revolve in the direction shown in FIG. 3. The roller bearings 22 extending from the center of each gear wheel 10 and 11, respectively, revolve in the cavities or recesses of the support plate 23; the support plate 23 maintains the roller bearings 22 at a constant distance. Thus, due to the support plate 23 and the roller bearings 22, the gear wheels 10 and 11 are engaged with one another throughout the operation of the engine.

Figure 12:
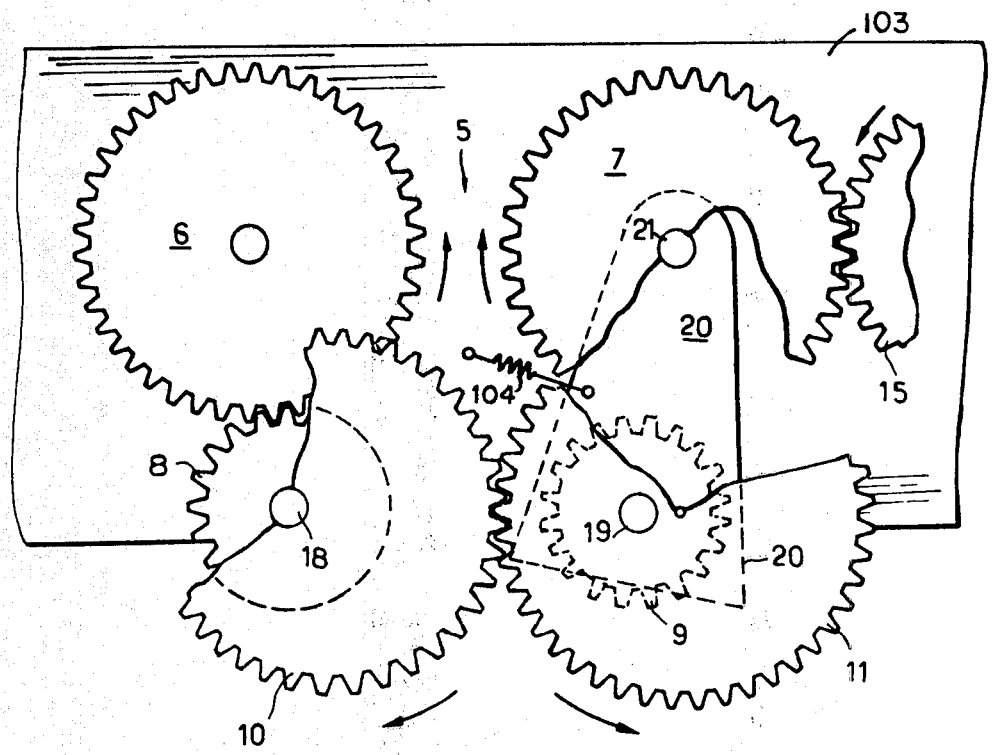
FIG. 12 is a diagrammatic detail of the gear train of my invention, showing a spring mounted on the crankcase and the plate member for urging the eccentrically mounted gear wheels to make contact with one another.

In a preferred embodiment of the invention, shown in FIG. 12, and primarily applicable to small one-cylinder engines, one end of a very stiff tension spring 104 could be mounted on position-shiftable support means in the form of a plate member 20, (thus replacing the support plate 23 shown in FIG. 3) and its other end could be mounted on the crankcase 103, so as to keep the eccentrically mounted gear wheels 10 and 11 in permanent contact, the tension spring 104 and the plate member 20 thus constituting part of the engagement means. Either a coil spring or a hardened helical spring of steel could be used.

In another embodiment of the invention, not shown in the drawings, the device described in the present invention could be adapted to a two-stroke or four-stroke engine, and the engine could be air-cooled, or water-cooled. In a water-cooled four-stroke engine, openings would be bored in the upper part of the cylinders and the valve housings, and valve seat housings would be placed within these openings. In the case of air-cooled engines, the cylinder heads may be laid directly on to flat parts provided on the cylinders. Sparking-plugs 26 would be placed in holes bored in the cylinders, exactly opposite the inlet valves. One would have to take into consideration the fact that ignition takes place very close to the head of the piston 3, in order not to interfere with the centrifugal-type or contact-type ignition advance cams or the like, which are required for the various types of ignition systems employed.

In another embodiment of the invention, it is possible to control the compression ratio of the gases; to achieve this, it is sufficient to vary the distance between the heads of the pistons 3 and 4 by very simple means, such as stroke of the crankshafts, length of the connecting rods, length of the cylinders, and the like.

The relative positions of the pistons, connecting rods, and crankshafts in the different stages of one cycle of the engine, according to the present invention, is shown diagramatically in FIGS. 4 through 11.

As shown in FIG. 4, the crankshaft 1 is positioned at 90°, and the crankshaft 2 at 180° at the precise moment when ignition takes place triggered by the spark plug 26; the pistons 3 and 4 are operative, and valves 24 and 25 will naturally be closed. The operative radius of the eccentric gear wheel 10 at this moment in time is defined by the "long" radius 12, while the operative radius of the eccentric gear wheel 11 at this time is defined by the "small" radius 13.

Figure 5:
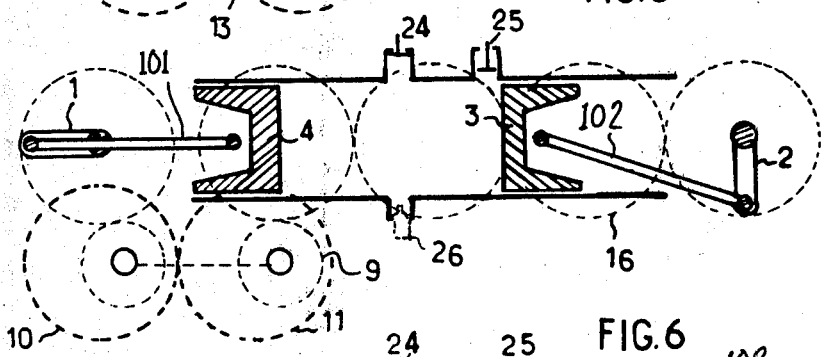
FIG. 5 is a fragmentary elevational view of the relative positions of the pistons in a second position of the operating cycle of the engine.

As shown in FIG. 5, after a 90° revolution, the piston 4 arrives at the outer dead center, when its crankshaft 1 has traversed 90°; the crankshaft 2 has also traversed 90°, and its associated piston 3 has just passed the exhaust valve 25, which is about to open. The respective positions of the eccentric gear wheels 10 and 11 are reversed after half a revolution.

Figure 6:
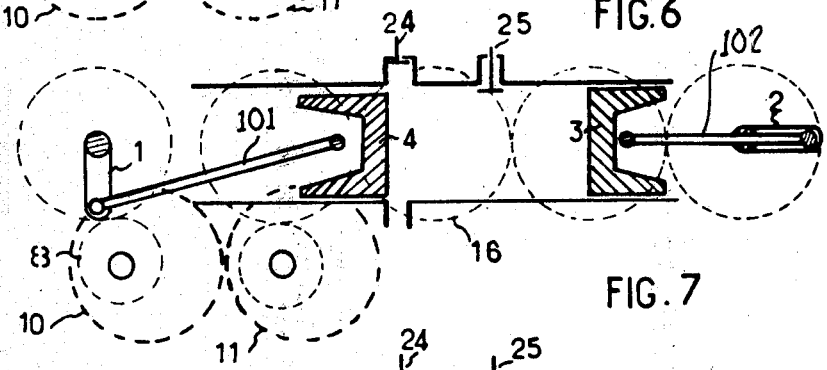
FIG. 6 is a fragmentary elevational view of the relative positions of the pistons in a third position of the operating cycle of the engine.

As shown in FIG. 6, the crankshafts 1 and 2 have rotated a further 90°, and the exhaust valve 25 is then fully open. The burnt gases are expelled when the eccentrically mounted gear wheels 10 and 11 have completed half a revolution.

Figure 7:
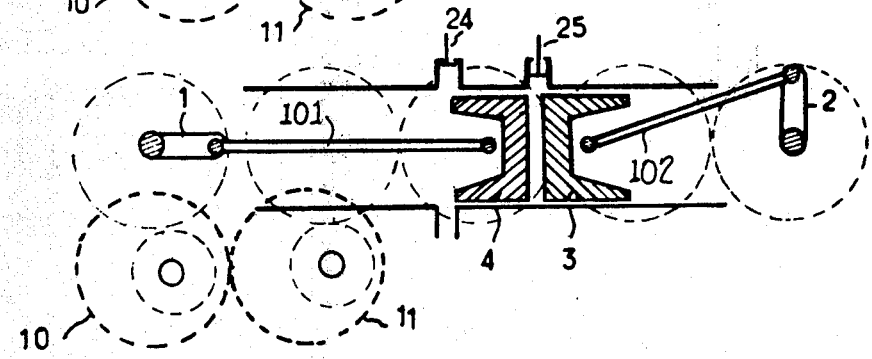
FIG. 7 is a fragmentary elevational view of the relative positions of the pistons in a fourth position of the operating cycle of the engine.

As shown in FIG. 7, the crankshafts 1 and 2 have completed a further 90° of revolution, thus positioning pistons 3 and 4 immediately below the exhaust valve 25, which closes simultaneously. The burnt gases have been expelled, and the inlet valve 24 has been closed.

Figure 8:
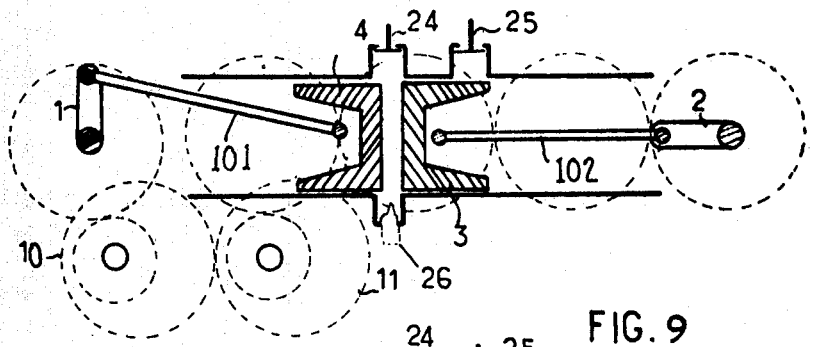
FIG. 8 is a fragmentary elevational view of the relative positions of the pistons in a fifth position of the operating cycle of the engine.

As shown in FIG. 8, the crankshafts 1 and 2 have completed a further 90° of revolution beyond their position shown in FIG. 7. The gap between the pistons 3 and 4 has remained constant during their movement from the exhaust valve 25 to the inlet valve 24, due to the eccentric gear wheels 10 and 11. The eccentric gear wheels 10 and 11 still cause a relative acceleration of the crankshaft 2 and a relative deceleration of the crankshaft 1, at this moment in time.

Figure 9:
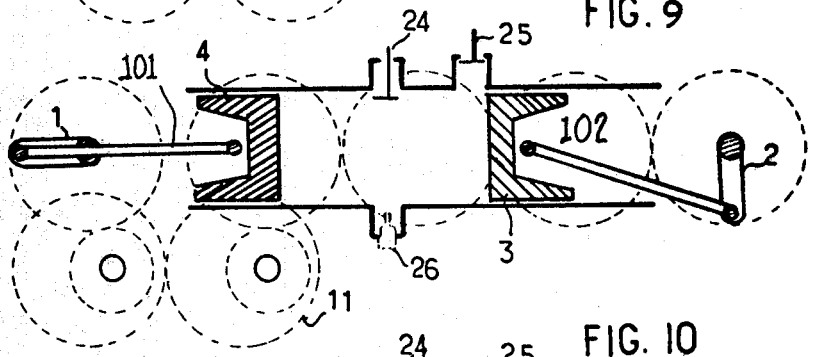
FIG. 9 is a fragmentary elevational view of the relative positions of the pistons in a sixth position of the operating cycle of the engine.

As shown in FIG. 9, the crankshaft 1 has arrived at the outer dead center subtending an angle of 180°, and the crankshaft 2 then subtends an angle of 270°; the pistons 3 and 4 are at about maximum distance from each other. The inlet valve 24 is open, and the exhaust valve 25 is closed; the fuel mixture is drawn into the cylinder, while the eccentric gear wheels 10 and 11 accelerate the crankshaft 1 and slow down the crankshaft 2.

Figure 10:
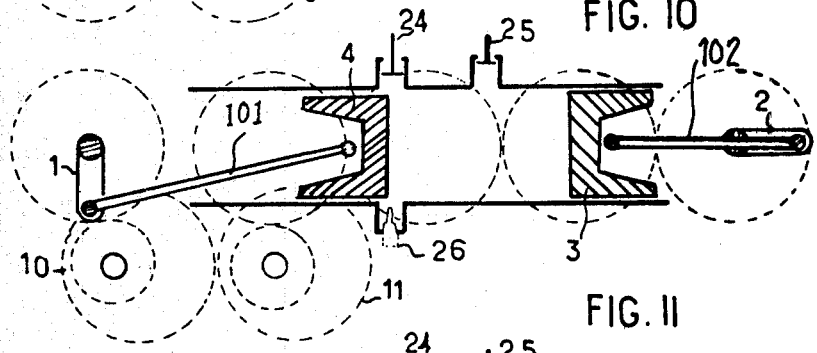
FIG. 10 is a fragmentary elevational view of the relative positions of the pistons in a seventh position of the operating cycle of the engine.

As shown in FIG. 10, the crankshafts 1 and 2 have been rotated by a further 90° beyond their position shown in FIG. 9; the piston 4 approaches and passes under the inlet valve 24, which closes; the exhaust valve 25 is closed. The cylinder has received the fuel mixture.

Figure 11:
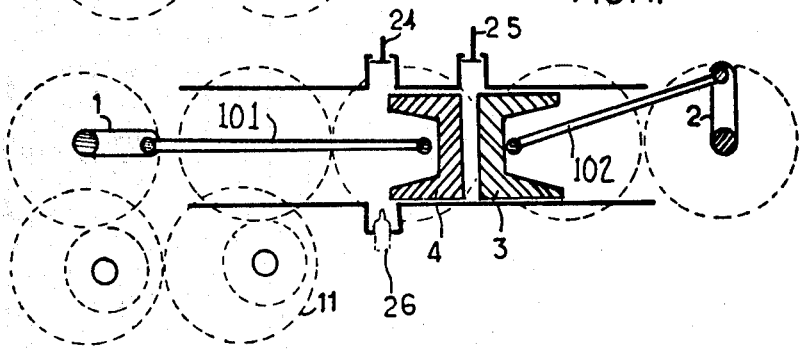
FIG. 11 is a fragmentary elevational view of the relative positions of the pistons in an eighth position of the operating cycle of the engine.

As shown in FIG. 11, the two pistons 3 and 4 have now compressed the gases below the exhaust valve 25, which is closed; the gaseous fuel mixture will remain compressed, while the gases are pushed below the inlet valve 24 during subsequent movements of the pistons 3 and 4, when ignition of the gases is triggered again by the spark plug 26, as shown in FIG. 4; the cycle is then repeated.

The device described in the present invention can operate on various sources of energy, such as gasolene, natural gas, and even fuel-oil; in the case of fuel-oil, the position of the eccentric gear wheels 10 and 11 will have to be adjusted in order to obtain a suitable compression ratio, and the required temperature.

The device can be fitted to automobiles, having much smaller stroke volumes than those known at present, but yielding the same power output; or it can be fitted to engines operating with conventional stroke volumes, but at operating revolutions per minute comparable to the idling revolutions per minute of conventional engines. Therefore, such internal combustion engines will require different transmission gear ratios to compensate for the relatively slow speed of the engine.

The device can be particularly advantageously applied to mopeds, motorcars and, more generally, to any vehicles used for transportation.

It will be further apparent that numerous variations and modifications may be made in the apparatus of the present invention, by anyone skilled in the art, in accordance with the principles of the invention herein above set forth, without the exercise of inventive ingenuity.

I claim:

1. An internal combustion engine adapted to be powered by a burnable gas fuel, comprising in combination:

at least one cylinder, at least first and second pistons reciprocally movable in said cylinder substantially in opposite directions, each piston having a maximum velocity range, and a maximum acceleration range therein, inlet and outlet valves for controlling the flow of the gaseous fuel into said cylinder, and the exhaust of the burnt fuel therefrom, respectively, and linkage means connected to said pistons for converting the reciprocating movement thereof into a rotary movement, and including change-of-rate-of displacement and velocity means increasing the rate of velocity in the maximum acceleration range, and for reducing the rate of displacement in the maximum velocity range of one piston with respect to the other piston, at least first and second piston rods pivotably connected to said first and second pistons, respectively, first and second crankshafts pivotably connected to said first and second piston rods, rotatable about first and second axes disposed substantially parallel to, and displaced by a predetermined angle from one another, respectively, and gear means coupling said first and second crankshafts to one another, said gear means including first and second fixedly mounted gearwheels, first and second eccentrically mounted gearwheels, and at least partially position-shiftable coupling means for coupling said first gear wheels and said second gear wheels to one another, respectively, said coupling means including engaging means for meshing said eccentrically mounted gear wheels to one another.

2. An internal combustion engine as claimed in claim 1, wherein said coupling means include first and second toothed wheels rigidly mounted with said first and second eccentrically mounted wheels about respective common first and second rotating axes, and engaging said first and second gear wheels, respectively, and position-shiftable support means, at least one of said eccentrically mounted gear wheels being rotatably mounted on said position-shiftable support means.

3. An internal combustion engine as claimed in claim 2, wherein said engaging means includes a plate formed with first and second recesses, and first and second roller bearings mounted on, and extending from said first and second eccentrically mounted gear wheels, so as to be freely rollable in said recesses, respectively.

4. An internal combustion engine as claimed in claim 2, wherein said position-shiftable support means includes a member having one end pivotably mounted on at least one of said gear wheels, and wherein said one of said eccentrically mounted wheels is rotatably mounted on the other end of said member.

5. An internal combustion engine as claimed in claim 2, wherein said first and second toothed wheels include first and second shafts concentric therewith, and concentric with said first and second axes, respectively.

6. An internal combustion engine as claimed in claim 4, wherein said one of said eccentrically mounted gear wheels has a diameter exceeding the diameter of the toothed wheel engaged therewith.

7. An internal combustion engine as claimed in claim 2, wherein each of said fixedly mounted gear wheels has about twice the diameter of each of said toothed wheels.

8. An internal combustion engine as claimed in claim 1, wherein the number of pistons is twice the number of cylinders.

9. An internal combustion engine as claimed in claim 2, further comprising resilient means coupled to at least said position-shiftable support means for urging said eccentrically mounted gear wheels to make contact with one another.

10. An internal combustion engine as claimed in claim 1, wherein said predetermined angle has one of the values $\pm 90° + n.\ 180°$, n being an integer.

* * * * *